US005316293A

United States Patent [19]

Hamilton

[11] Patent Number: 5,316,293

[45] Date of Patent: May 31, 1994

[54] SIGNAL EMITTING BALL

[76] Inventor: David H. Hamilton, 5506 B. St., Little Rock, Ark. 72205

[21] Appl. No.: 51,652

[22] Filed: Apr. 26, 1993

[51] Int. Cl.[5] ..... A63B 43/06; A63B 37/06

[52] U.S. Cl. ..... 273/65 EF; 273/65 EG; 446/400; 446/485

[58] Field of Search ..... 273/65 EF, 58 G, 65 ED; 446/230, 400, 397, 484, 485

[56] References Cited

U.S. PATENT DOCUMENTS

| | | | |
|---|---|---|---|
| 2,686,987 | 8/1954 | Garofalow | 446/400 |
| 4,552,542 | 11/1985 | Reysman | 446/485 X |
| 4,595,200 | 6/1986 | Shishido | 273/65 EF X |
| 4,776,589 | 10/1988 | Yang | 273/58 G |
| 4,801,141 | 1/1989 | Rumsey | 273/58 G X |
| 4,923,196 | 5/1990 | Rohring | 273/65 EF |
| 5,066,011 | 11/1991 | Dykstra | 273/65 EF X |
| 5,112,055 | 5/1992 | Barnhill | 273/58 G X |
| 5,186,458 | 2/1993 | Redondo | 273/65 EF |
| 5,203,560 | 4/1993 | Wang | 273/58 G X |
| 5,236,383 | 8/1993 | Connelly | 446/485 X |

*Primary Examiner*—George J. Marlo
*Attorney, Agent, or Firm*—Stephen D. Carver; Jerry L. Mahurin

[57] ABSTRACT

A toy ball, preferably a football, that emits light and bomb-emulating sounds when spiraled. It comprises a foam body defining a central bore with open ends, conical end caps associated with the ends, and an electronic circuit responsive to a centrifugal switch. The circuit and its battery are fitted within a tubular canister, preferably coaxially disposed in the bore. Rubber tethers suspend the canister between the end caps. A D-ring bracket flexibly connects one end of each tether to the canister. An S-hook connects the other tether end to an end cap. When the ball spirals during flight, a sound simulating a bomb dropped from an aircraft is emitted from piezoceramic transducers mounted on the lids of the canister. Sound horns extend from the transducers to the end caps to conduct the sound. Radially spaced apart light emitting diodes mounted in recesses in the outer surface of the ball are activated by the circuit. The centrifugal switch is responsive to rotation of the ball about its longitudinal axis, as created by a spiral pass. The tethers and end caps facilitate service of the components in the central bore. The foam may be compressed and an end cap unhooked from the suspension system to allow access to the transducers or the circuit canister.

20 Claims, 4 Drawing Sheets

SIGNAL EMITTING BALL

BACKGROUND OF THE INVENTION

1. Field of the Invention

The present invention generally relates to footballs. More particularly, the present invention relates to centrifugally activated sound and/or light emitting footballs which have a main body construction of foam rubber. Art pertinent to the present invention is found in U.S. Patent Class 273, subclass 58.

2. Description of the Prior Art

As recognized by those skilled in the art, balls which are made of foam rubber are quite popular. Additionally, sound generating devices involving integrated-circuits are gaining in popularity. The compactness and rugged nature of modern electronics allow toys to exhibit a variety of audiovisual effects which were hitherto unknown.

Lighting has been employed in toy balls for various purposes in the prior art. Hendry, U.S. Pat. No. 3,894,411, discloses a ball having internal lighting system which is intended to be used in various games of skill and chance. Allen, U.S. Pat. No. 3,229,976, discloses an illuminated beach ball. This ball incorporates a central channel which receives flash light batteries and a light bulb. Yang, U.S. Pat. No. 4,776,589, discloses a lighted inflatable ball. This ball defines a central compartment intended to receive a battery pack. Wires extend out of this compartment through a blockading member into the inflated portion of the ball to light small light bulbs.

Johnson, U.S. Pat. No. 3,786,246, discloses an illuminated flying toy saucer. This device has a simple on/off switch which operates a plurality of lights disposed at the periphery of a flying saucer toy. Newcomb, U.S. Pat. No. 4,002,893, discloses an illuminated ball in the general shape of a football. This ball must be partially disassembled to reach its operating switch.

Several devices are know in the art that produce sound or light responsive to movement. U.S. Pat. No. 3,610,916, issued to Meehan on Oct. 5, 1971, discloses an illuminated ball with a time delay device. This ball employs an inertia device to illuminate internal light bulbs powered by a central battery pack.

Deyerl, U.S. Pat. No. 3,304,651, discloses an intermittently and selectively illuminated ball. It employs a mercury switch to provide illumination responsive to movement.

Shishido, U.S. Pat. No. 4,595,200, discloses a sound emitting ball. This ball has a sound emitting circuit which is sensitive to external force being applied to the ball. The circuit and speaker are counterweighted by a weighted air valve.

Most pertinent to the present invention is Samuel, U.S. Pat. No. 3,798,834 that discloses a flying disc with an electronic signaling device activated by a centrifugal switch. A battery is secured within a chamber by a spring and the element it is intended to operate. The circuit is completed by a small, weighted contact element moving into an engagement with one terminal of the battery.

The known prior art does not disclose a football actuated by a centrifugal switch to emit sound or light. When a football is most accurately thrown, a significant "spiral" is put on the ball. In other words, to help stabilize the flight of a football the passer ordinarily spins the ball about its longitudinal axis. No known prior art discloses a football device which takes advantage of this spin to actuate a switch operating a self-contained noise and light-generating circuit. Nor does the art disclose a ball employing electronic circuitry which can withstand the rugged treatment visited upon a football. Previously known circuits are rigidly mounted subjecting the components to the full force of impact.

Hence, it is desirous to provide a football which is responsive to a "spiral" to emit an audio and/or visual signal. It would be necessary for electronic circuitry in such a ball to be placed in a position in which it was insulated from impact and the elements Additionally by suspending the circuitry it would be resistive to damage as the result of instantaneous deceleration. Furthermore, due to the rough nature of football, it would be advantageous if this device were user serviceable to allow changing of batteries and repair or replacement of parts in the field with only a minimum of effort.

SUMMARY OF THE INVENTION

I have developed a resilient and impact-absorbing toy ball that emits light and sound during play. In the best mode it is in the form of a football. The design takes advantage of the longitudinal spin or "spiral" of a well thrown ball to activate a centrifugal switch and a self contained electronic circuit to concurrently output sound or light. Specifically, my football makes an "incoming bomb" sound as it spirals through the air. It is preferably illuminated by a plurality of peripheral, spaced apart light emitting diodes that make it easy to see in darkness.

Preferably the ball is constructed of foam rubber. A central cavity or bore running the length of the ball holds a weatherproof canister in which the circuitry is housed. The canister is suspended between opposite end caps. Therefore, the circuit is insulated from direct impact due to the surrounding foam. Furthermore, by suspending the canister, sudden deceleration is absorbed by the suspension system, not by the components of the circuit. The foam of the ball, the suspension system, and the end caps facilitate service of the components in the central bore. The foam may be compressed and an end cap unhooked to allow access to the canister and the circuit.

The foam body of the football has a non porous outer coating and uniformly spaced dimples. The generally conical end caps complete the outer shape of the football. To facilitate ball handling the end caps are made of a relatively soft plastic. Radial slits are defined in the caps to permit passage of sound from the bore.

The tubular canister has snap fit lids secured on each end. Wires extend from the circuit within the canister to piezoelectric transducers disposed on lids. Wires may also extend to light emitting diodes recessed into the outer skin of the football. The circuit is largely disposed on a circuit board. The board is retained within the canister, as is a battery. The battery is positioned to preserve the ball's center of gravity, along its longitudinal axis.

Foam sound horns with a smooth inner coating extend from the transducers to the end caps to aid transmission of sound from the interior of the ball to the exterior.

Tethers suspend the canister between the end caps. Each rubber tether is secured to the canister by a D-ring and to the end cap by a detachable S-hook. When the football is to be disassembled for maintenance (i.e., to change the battery), one of these hooks is disconnected to permit access to the canister.

The centrifugal switch has a weighted arm. When the ball spins about its longitudinal axis the weighted arm moves outwardly relative to the axis to close the switch and activate the circuit. It is important that the switch remain closed as long as there is acceleration (i.e., during spiraling in flight) but that the circuit open once the ball is caught or comes to rest. The circuit comprises an integrated circuit which transmits a signal to a transformer circuit boosting the output to the transducers.

Therefore a primary object of the present invention is to provide a signal emitting toy ball.

Another fundamental object is to provide a toy football that radiates light and sounds during play.

Another important object is to provide a light and/or sound emitting football which is inherently shock resistant.

A further object is to provide a toy ball that is extremely entertaining to children.

Another important object is to provide a highly visible toy ball that is easy to see and hear during play.

A related object is to provide a toy ball that may be used at night or in near darkness.

A related object of the present invention is to provide a sound or light emitting football which insulates sensitive circuitry from exterior impacts.

A related object is to provide a signal emitting football which provides shock resistive mounting for its circuitry.

An object is to provide a signal emitting football in which the electronic circuitry is contained within a waterproof canister.

Another important object is to provide a signal emitting football which is user serviceable.

A related object of the present invention is to provide a signal emitting football in which the battery may be easily accessed and replaced.

A further related object of the present invention is to provide a signal emitting football in which the circuitry associated therewith is modular in nature and therefore easily replaceable.

An object of the present invention is to provide a signal emitting football with superior acoustical characteristics.

An object of the present invention is to provide a signal emitting football which provides for efficient emanation and propagation of sound waves along the flight of the ball.

A further object is to provide a signal emitting football of the character described in which signals are generated in response to spiraling. It is a feature of my invention that a centrifugally-actuated switch activates the ball's signal generation circuitry.

Another object of the present invention is to provide a signal emitting football in which dynamic balance is maintained through the proper positioning of the battery and other masses within the ball.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
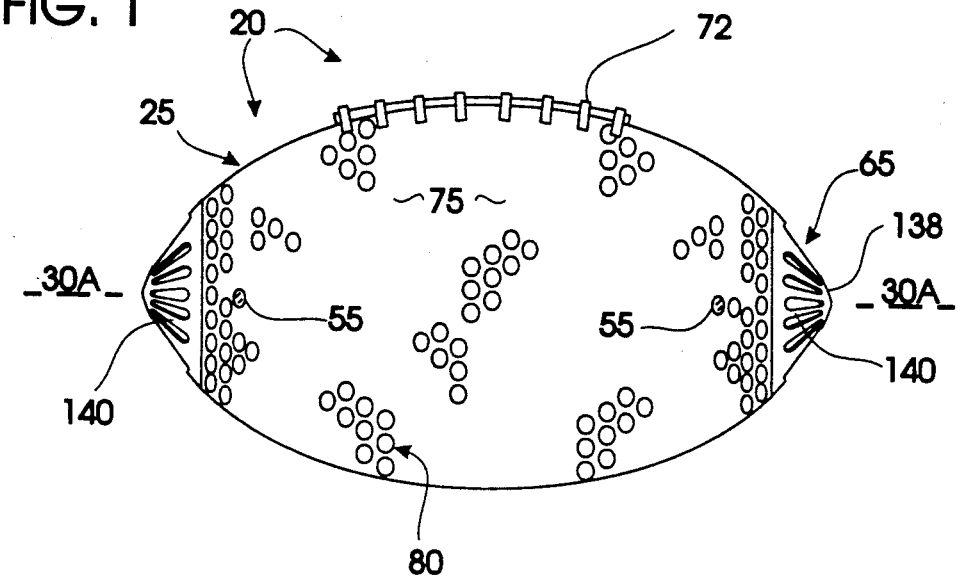
FIG. 1 is an elevational side view of my Signal Emitting Football.
Figure 2:
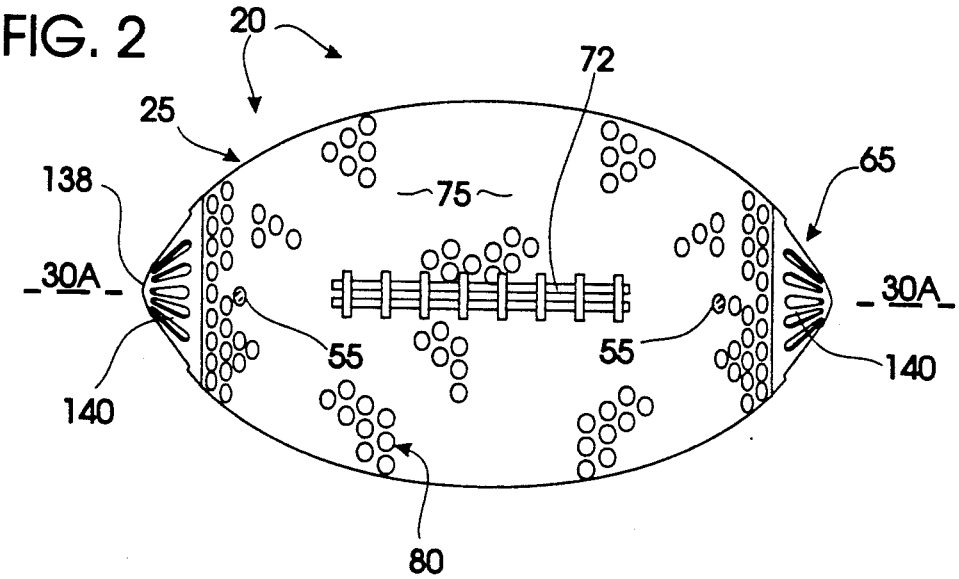
FIG. 2 is a top plan view thereof.
Figure 3:
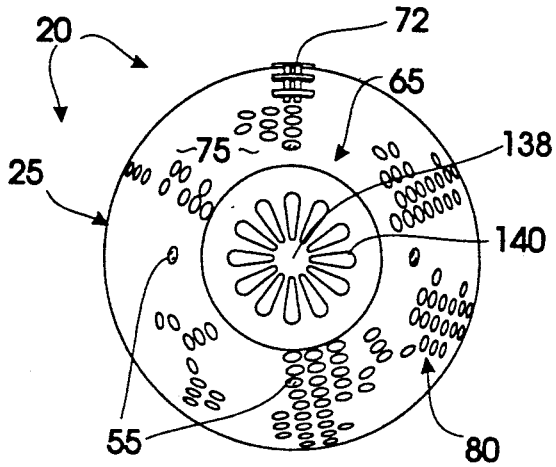
FIG. 3 is an end elevational view thereof.
Figure 4:
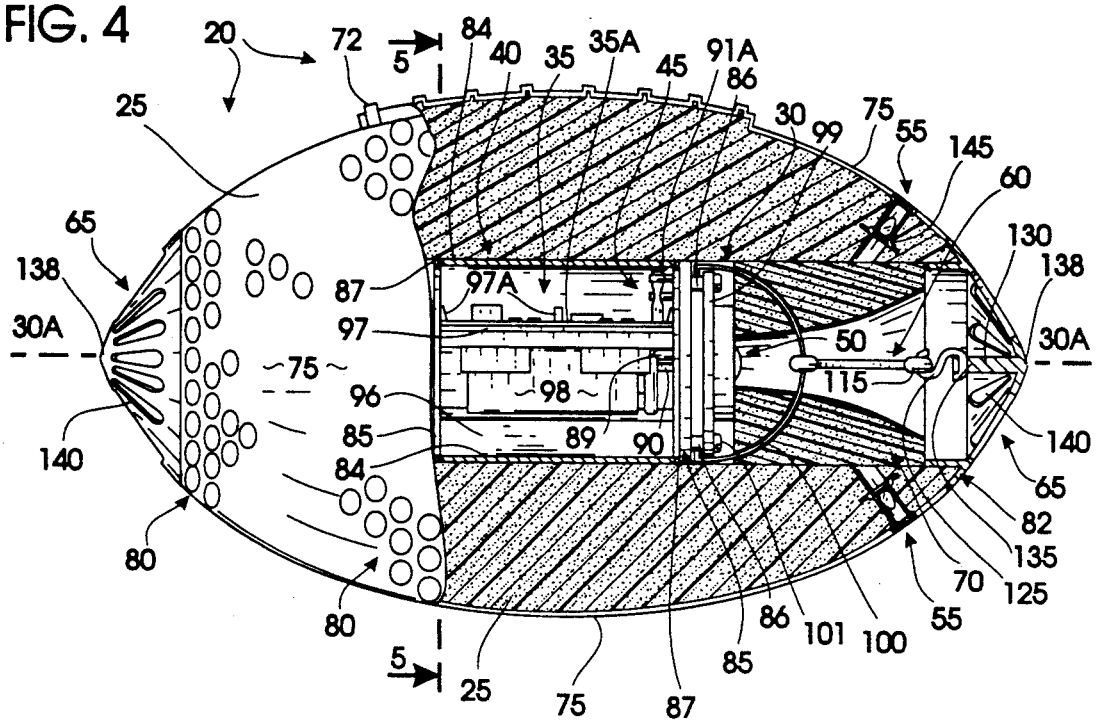
FIG. 4 is an enlarged, longitudinal, fragmentary, side elevational view with portions thereof shown in section or broken away for clarity and with other parts omitted for brevity.
Figure 5:
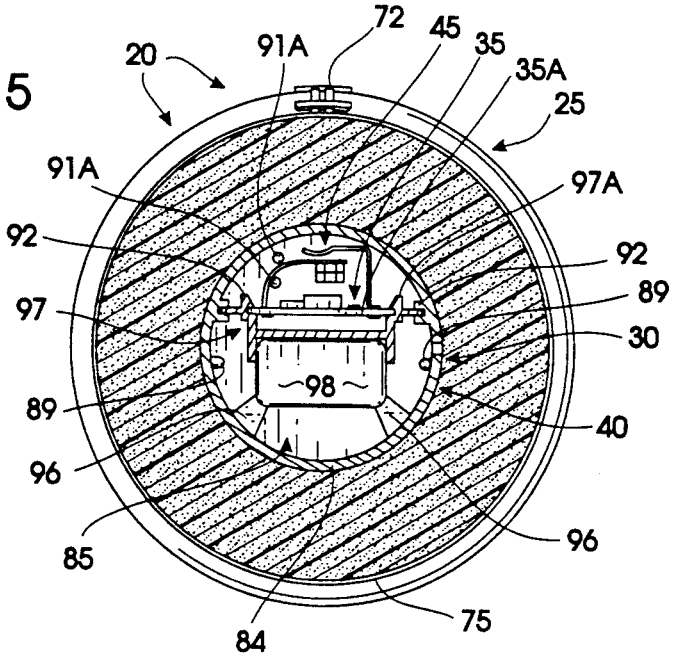
FIG. 5 is a fragmentary vertical sectional view taken generally along line 5—5 of FIG. 4.

With reference now directed to the accompanying drawings, my new signal-emitting toy ball is broadly designated by the reference numeral 20. As detailed below, ball 20 is in the form of a football. It comprises a foam body 25 defining a central bore 30. An electronic circuit 35 is disposed within a canister 40 suspended in the bore 30. A centrifugally actuated switch 45 controls the circuit 35 which in turn sends a signal to transducers 50 mounted in the ends of the canister 40. Alternatively the circuitry activates lights 55 disposed on the periphery of the football 20. The canister 40 is suspended between tethers 60 extending to end caps 65 disposed on either end of the ball 20. Sound horns 70 are disposed between the transducers 50 and the end caps 65 of the ball 20 improving the sound output. Preferably, the sound produced by the present football 20 is reminiscent of the sound associated with an aircraft released bomb or ballistic shell.

As pointed out above the main body 25 of the football 20 is made of foam rubber. The body 25 has the general shape of a prolate spheroid. Preferably, simulated lacing 72 is cast into the body 25. A nonporous, smooth outer coating 75 reduces wind resistance. To further improve flight characteristics, the body 25 also defines uniformly spaced dimples 80. The central bore 30 is cast into the body 25 of the ball during its formation. This bore 30 is coincident with the longitudinal axis 30A of the ball 20 and each end 82 of the bore 30 is open.

Figure 6:
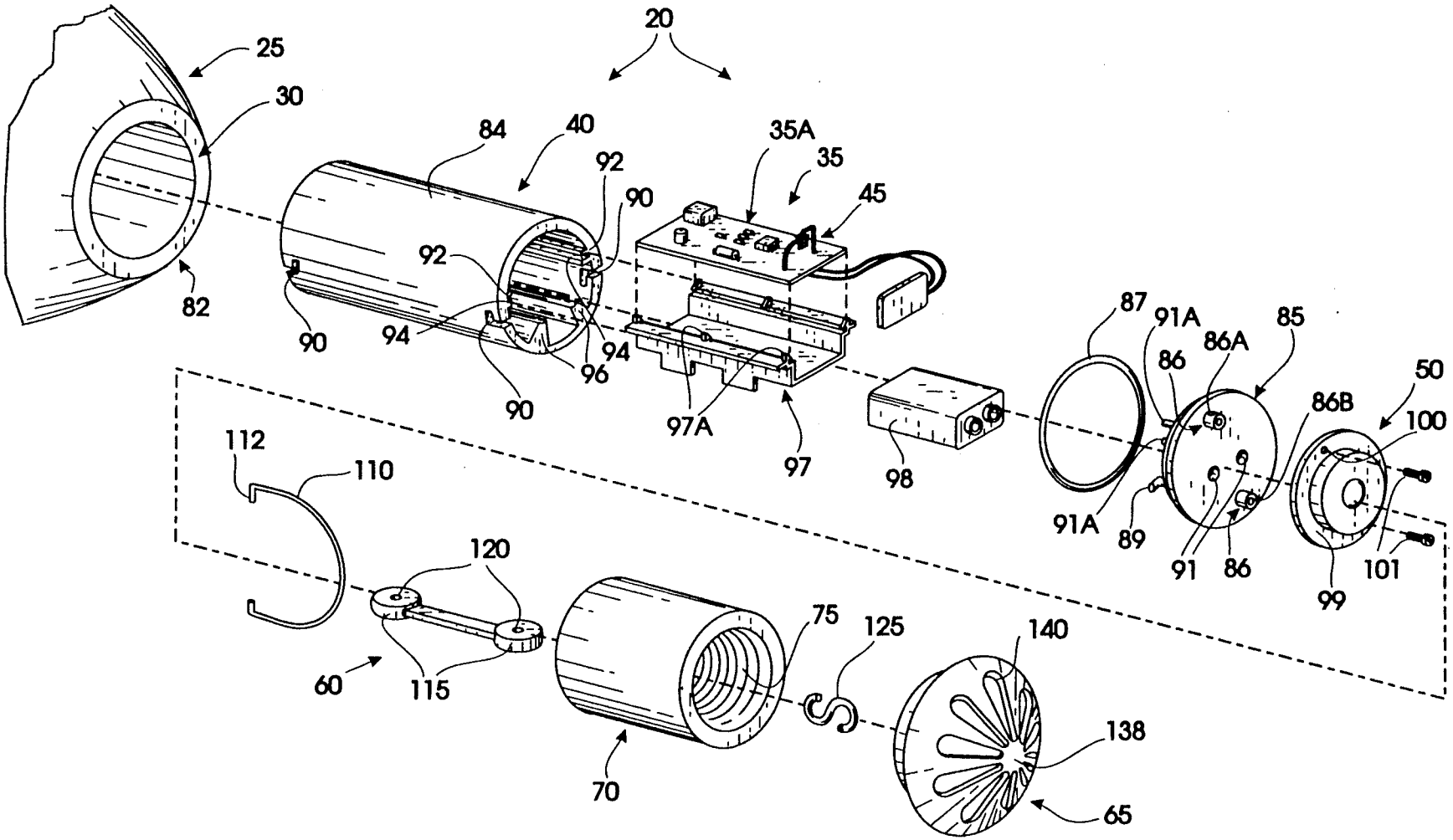
FIG. 6 is an exploded pictorial view of the football assembly with parts omitted for brevity; and, FIG. 7 is an electrical schematic diagram of the best mode circuit known to me at this time.

A canister 40 is disposed within the central bore 30. The canister 40 comprises a generally tubular shell 84 and lids 85 disposed on either end. Two generally circular bosses 86 extend outwardly from each lid 85. These bosses 86 have orifices defined in the sides and into the center 86A, 86B (FIG. 6). The lids 85 are sealed with an O-ring 87. Snap-fit tabs 89 secure the lid 85 to the canister. The tabs 89 mate with J-shaped slots 90 defined in the shell 84. The tabs 89 and slots 90 require only slight rotation of the lid 85 to lock. This is necessary as the wires from the circuit 35 to the transducers 50 or the lights 55 pass through openings 91 in the lids 85. Two projections 91A from the lid reinforce the centrifugal switch 45. Various protrusions 92, 96 are defined on the interior walls of the canister shell 84. Two pairs of ribs 92 opposing each other form channels 94 on the interior wall to receive the circuit board 35A. A tray 97 may receive the circuit board 35A. If a tray 97 is employed a set of latches 97A are required to hold the board 35A to the tray 97. Two elongated supports 96 radially extending toward the center of the canister 40 support a battery 98 powering circuit 35. The battery 98 is supported in a spaced apart relationship from the shell 84 of the canister 40 toward the center of gravity or longitudinal axis 30A of the ball 20. By placing the battery 98 near the center of gravity the flight characteristics of the ball 20 are stabilized.

Piezoceramic transducers 50 disposed on the canister lids 85 function as speakers. A flange 99 extending outwardly from the transducers 50 has openings 100 disposed in them. Two of these openings 100 mate with the orifices 86B disposed in the center of the bosses 86 extending outwardly from the canister lid 85. Self tapping screws 101 secure the transducer 50 to the boss 86 in a spaced apart relationship with the canister lid 85. The sound horns 70 extend from the transducers 50 to the end caps 65 of the ball 20. Preferably, these horns 70 are formed of foam material similar to the body 25 of the football 20. The interior of the horns 70 are coated with a smooth material 75 similar to the exterior of the ball 20. The resultant smooth surface facilitates transmission of sound from the interior of the ball 20 to the exterior.

Tethers 60 extend from the canister 40, through the center of the horns 70, to the end caps 65. A D-shaped loop or ring 110 is swingably secured to each lid 85. The ends 112 of the D-ring mate with the orifices 86A disposed in the sides of the bosses 86 extending outwardly from the lids 85 of the canister 40. The tether 60 is a length of rubber chord having generally reinforced ends 115 defining orifices 120. One of these orifices 120 is slidably mated with the D-ring 110. The other orifice 120 receives an "S" shaped hook 125. The end caps 65 define a boss 130 with a lateral orifice 135 to receive the "S" hook 125.

The end caps 65 are generally conical in shape with a rounded point 138. The caps 65 continue the contour of the body 25 of the football 20 and are constructed of a relatively soft plastic to facilitate catching and handling of the ball 20. Radially extending slits 140 perforate the end caps 65. These slits 140 facilitate the transmission of sound from the horns 70.

As mentioned above, lights 55 may be disposed on the periphery of the ball 20. Preferably these lights are light emitting diodes (LEDs) disposed near the end cap 65. Sockets 145 embedded in the foam of the body 25 receive the LEDs and hold them in place.

Figure 7:
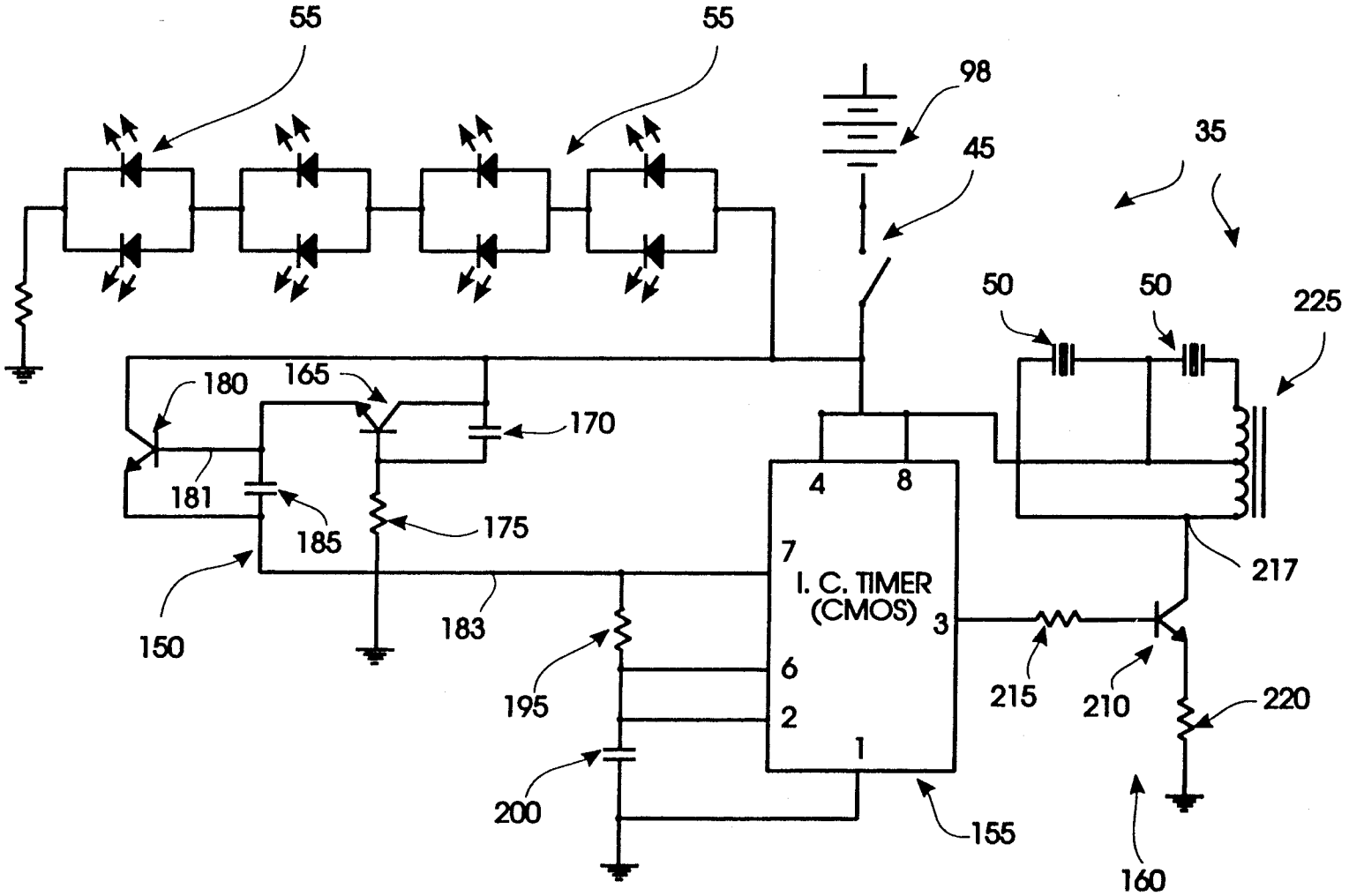

The preferred control circuit 35 (FIG. 7) comprises a one shot Darlington driver 150 that activates an integrated circuit 155. Circuit 155, preferably a "555" oscillator integrated circuit, in turn transmits a signal to an amplifier-transformer circuit 160 which excites piezoceramic transducers 50. The IC 155 functions as an astable multivibrator whose output is a square wave signal, the frequency of which is controlled by the sweep voltage at pin 7.

The centrifugal switch 45 is normally open when the ball is at rest. The switch is closed when the ball is spiraled during a throw. When the ball rotates about its longitudinal axis, radial acceleration maintains switch 45 closed. Upon closure of the switch 45 current is applied to all function blocks and the LED's 55. When the ball comes to rest, or stops spiraling, the switch opens and the noise stops.

Circuit 150 preferably comprises a Darlington circuit combined with a one shot multi-vibrator comprising transistor 165, capacitor 170 and resistor 175. Upon closure switch 45 applies a pulse through capacitor 170 to energize transistor 165 that in turn activates transistor 180 through line 181. Transistor 180 activates IC 155 via line 183. Capacitor 185 charges to approximately sixty-six percent of the voltage of power supply 98. At the end of the pulse capacitor 185 begins to discharge. The discharge rate is a time function supplying a downward sweeping voltage to pin 7 of the 555IC timer to control frequency. As a result, a tone sweep needed for the desired "bomb drop" effect is generated by the transducers 50.

Resistor 195 and capacitor 200 in the tone generator portion of the circuit establish time constants for frequency. An initial audio frequency of approximately 7500 Hz. is desirable.

A driver amplifier 160 comprises transistor 210, resistors 215 and 220 and autotransformer 225, employed to minimize space and weight Resistor 215 limits the current applied to the base of transistor 210. Resistor 220 limits the emitter current of transistor 210 to avoid thermal runaway. Circuit 160 outputs a square wave, which is an amplified copy of the signal outputted from IC 155. The output at node 217 is applied to an outside leg of autotransformer 225, which drives the Piezoceramic Audio transducers 50 to produce the audible "bomb drop" tone sweeps.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A signal emitting toy ball comprising:

a resilient body comprised of pliable material, the body defining a longitudinal axis, a central interior bore coincident with said axis, and at least one open end;

an electronic circuit disposed within said body;

switch means disposed in said ball for activating said circuit in response to acceleration of said ball;

transducer means for generating sound in response to said circuit; and, end cap means associated with said at least one open end for distributing sound from said transducer means.

2. The toy ball defined in claim 1 further comprising canister means for enclosing said circuit, said canister means disposed in said bore, and tether means for suspending said canister means between said ends.

3. The toy ball defined in claim 2 further comprising sound horn means disposed between said transducer means and said end cap means for conducting sound.

4. The toy ball defined in claim 3 further comprising a plurality of light emitters responsive to said circuit for radiating light.

5. The toy ball defined in claim 4 wherein said circuit means comprises a circuit board adapted to be snap fitted within said canister means, and a battery secured in said canister means.

6. The toy ball defined in claim 5 wherein said tether means comprises:

resilient cord means for anchoring said canister means, said cord means comprising spaced apart ends having eyes;

S-shaped hook means for connecting one of said eyes to said end cap means; and,

D-shaped bracket means for connecting the second eye to said canister means.

7. An illuminated, audible football comprising:

a foam football body defining a central bore and open ends;

perforated, generally conical end caps disposed over said open ends;

one or more acceleration activated switches disposed in said football;

electronic circuit means for activating said ball responsive to said switches;

canister means for captivating said circuit means, said canister means coaxially disposed in said bore;

means for mounting said canister means between said end caps within said bore;

transducer means for generating sound in response to said circuit means; and, sound horns extending from said speaker means to said end caps for conducting sound.

8. The football as defined in claim 7 wherein said transducer means comprises piezoceramic transducers disposed on said canister means.

9. The football as defined in claim 7 further comprising a plurality of light sources disposed exteriorly of said body for radiating light in response to said circuit means.

10. The football as defined in claim 9 wherein said light sources are light emitting diodes.

11. The football as defined in claim 7 wherein said mounting means comprises:

a pair of resilient cords for anchoring said canister means, said cords each comprising first and second spaced apart ends;

an S-shaped hook connecting said first ends to said end caps; and, a bracket flexibly connecting said second ends to said canister means.

12. The football as defined in claim 11 wherein said canister means comprises a tubular shell and a pair of spaced apart lids snap fitted to the shell, said tubular shell comprising internal rib means for mechanically mounting said circuit means.

13. The football as defined in claim 12 wherein said bracket comprises a D-shaped ring having a pair of ends, each of said lids comprises a pair of spaced apart bosses, and said D-shaped ring ends are swiveled to said bosses.

14. The football as defined in claim 13 wherein:

said speakers are piezoceramic transducers disposed in the lids of said canister means; and, a plurality of light emitting diodes are associated with said body for radiating light in response to said circuit means.

15. An signal emitting football comprising:

a generally prolate spheroidal foam body having a longitudinal bore coincident with a longitudinal axis, said bore terminating in open ends;

generally conical end caps disposed over said open ends, said end caps defining radial slits;

canister means coaxially disposed in said bore;

tether means for suspending said canister means between said end caps, said tether means extending from each of said end caps to said canister means;

electronic circuit means for generating electronic signals responsive to the spin of said football about said longitudinal axis, said circuit comprising at least one centrifugally activated switch.

16. The football as defined in claim 15 wherein said circuit further comprises:

a power source disposed in said canister;

a timer activated by one of said switches, said timer disposed in said canister; and, transducers disposed in lids sealing said canister means, said transducers adapted to receive and convert said signals to an audible sound.

17. The football as defined in claim 16 wherein said circuit further comprises a plurality of light emitting diodes disposed in recesses defined in a surface of said body, said light emitting diodes receiving and converting said signals to visual light.

18. The football as defined in claim 16 further comprising sound horns extending from said transducers to said end caps.

19. The football as defined in claim 16 wherein said sound varies from a high frequency to a low frequency.

20. The football as defined in claim 15 wherein said body comprises a smooth outer surface, said outer surface defining a plurality of evenly spaced, generally round dimples.

* * * * *